US006802702B2

(12) United States Patent
Gillert et al.

(10) Patent No.: US 6,802,702 B2
(45) Date of Patent: Oct. 12, 2004

(54) FEED PUMP FOR FLUIDIC MEDIA HAVING SLEEVE BEARING LUBRICATION

(75) Inventors: Georg Gillert, Ostbevern (DE); Dirk Henningsen, Ostbevern (DE)

(73) Assignee: Kreyenborg Verwal Tungen und Beteiligungen GmbH & Co. KG, Munster (DE)

( * ) Notice: Subject to any disclaimer, the term of this patent is extended or adjusted under 35 U.S.C. 154(b) by 0 days.

(21) Appl. No.: 10/472,426

(22) PCT Filed: Dec. 7, 2002

(86) PCT No.: PCT/DE02/04486

§ 371 (c)(1),
(2), (4) Date: Sep. 18, 2003

(87) PCT Pub. No.: WO03/050418

PCT Pub. Date: Jun. 19, 2003

(65) Prior Publication Data

US 2004/0109780 A1 Jun. 10, 2004

(30) Foreign Application Priority Data

Dec. 12, 2001 (DE) ..... 101 61 023
Jan. 24, 2002 (DE) ..... 102 02 618

(51) Int. Cl.[7] ..... F04C 2/18; F04C 15/00

(52) U.S. Cl. ..... 418/102; 418/206.8; 415/112; 415/176

(58) Field of Search ..... 418/102, 181, 418/206.8; 415/111, 112, 176

(56) References Cited

U.S. PATENT DOCUMENTS

| | | | | |
|---|---|---|---|---|
| 2,940,399 A | * | 6/1960 | Zieg et al. | 418/102 |
| 4,534,717 A | | 8/1985 | McCabe et al. | 418/181 |
| 5,096,396 A | | 3/1992 | Welch | 418/181 |
| 5,253,988 A | | 10/1993 | Hunziker et al. | 418/102 |
| 6,135,741 A | * | 10/2000 | Oehman, Jr. | 418/102 |

FOREIGN PATENT DOCUMENTS

| | | |
|---|---|---|
| EP | 0 061 630 | 3/1982 |
| EP | 0 628 725 | 12/1994 |
| EP | 1 164 293 | 12/2001 |
| GB | 322 778 | 12/1929 |

* cited by examiner

*Primary Examiner*—John J. Vrablik
(74) *Attorney, Agent, or Firm*—Merchant & Gould P.C.

(57) ABSTRACT

The invention relates to a feed pump for fluidic media, comprising a displacement body that is mounted in a pump housing and equipped with slide bearings and connecting channels that connect the slide bearings to the produce channel on the suction side for recirculating the fed medium that lubricates the slide bearings. The connecting channels are linked to control channels that lead to the exterior and guide channels are provided in the extension of the connecting channels in the housing of the cover. Said guide channels accommodate the valve plungers, each of which has a constriction. The section of the valve plunger lying adjacent to the product channel has a length and a diameter, which correspond to the length and diameter of the connecting channel.

2 Claims, 1 Drawing Sheet

FEED PUMP FOR FLUIDIC MEDIA HAVING SLEEVE BEARING LUBRICATION

Figure 1:
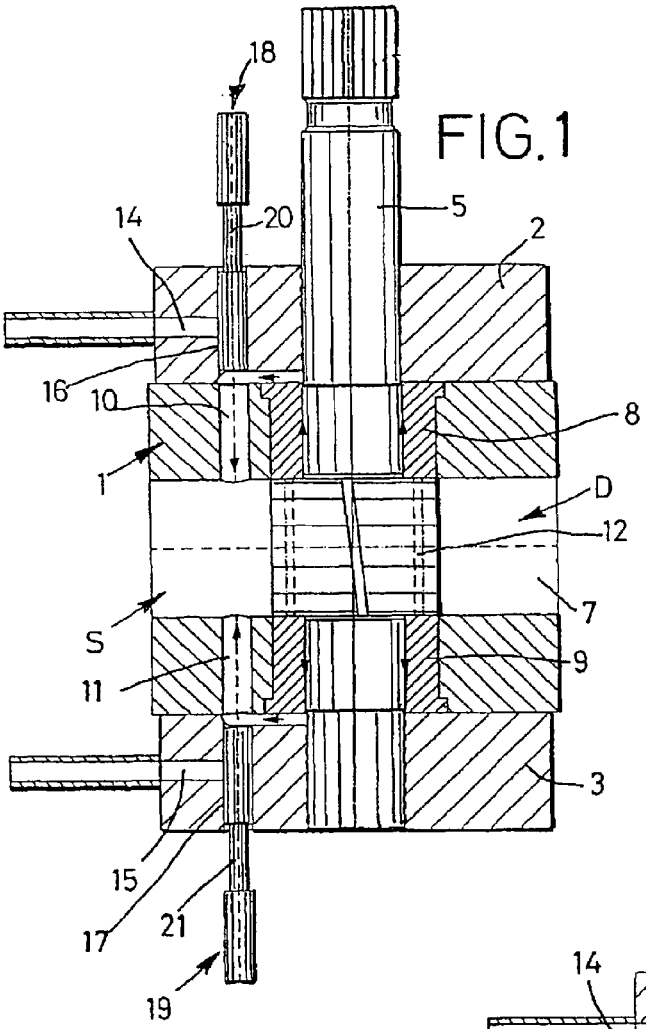

The invention relates to a feed pump for fluidic media.

Described in EP 0 061 630 A1 is a gear pump for metered feeding of lacquers, which pump is provided with a pump inlet and a pump outlet as well as with two gears that mesh with each other, which gears are rotatably supported inside a pump housing by a powered drive shaft and a stationary support shaft. This known arrangement is provided with a flushing-channel system for flushing of gaps between the gears, the shafts, and the pump housing prior to a color exchange, the flushing-channel system displaying at least one flush chamber and one closable inlet for a flushing agent and several flushing channels connected to the flushing chamber.

In this connection, known from EP 1 164 293 A2 is the arrangement of the flushing channels in the region of the drive shaft such that the flushing agent flows through the bearing gap of the drive shaft over the entire bearing width of the respective bearing sites, from the outside inwardly towards the front of the gear.

Using this known arrangement, the color residue is again and again inadequately rinsed out, so that during operation the situation arises where, to a greater or lesser degree, mixtures of colors are present.

Known from GB 322 778 is a feed pump that is designed as a gear pump in which the lubrication of the sleeve bearings takes place through the actual fed medium itself.

The sucking in of the fed medium, which serves as the lubricant, is caused by the differential pressure prevailing between the suction side and the pressure side in the product channel, and after the lubrication of the sleeve bearings the lubricant is released into the product channel at the suction side of the pump. Thus, the lubricant is, on the one hand, pushed by the pump pressure into the space of the sleeve bearings and, on the other hand, sucked out of the sleeve bearings by the low pressure prevailing at the suction side.

If a product exchange takes place in the product channel, then a dismantling of the feed pump is necessary in order to cleanse the sleeve bearings of the previously-fed product so that the mixing of products is prevented. This operation is complex and time-consuming.

The invention is based on the task of creating an arrangement whereby dismantling of the pump and the cleansing of the sleeve bearings will no longer be necessary, but rather the cleansing is to take place though the fed medium itself and it is to be possible to monitor from the outside whether this cleansing has completely occurred.

Express differently, in a feed pump having the form of a rotary piston pump or a gear pump and being arranged in a product channel, it is proposed that a guide channel be additionally provided, which guide channel is arranged on the suction side of the pump for both sleeve bearings and which is connected to the connecting channels that are designed to feed the fed medium lubricating the sleeve bearings and lead to the suction side of the pump. Arranged in these connecting channels are valve plungers having a constriction, which plungers can be shifted from one position, in which they do not hinder the fed medium (which lubricates the sleeve bearings) towards the suction side of the product channel, into another position in which this channel serving the recirculation of the lubricant is closed. Here, not only is the connecting channel closed, but also the valve plunger has a length in this region that corresponds to the length of the connecting channel, in order to avoid dead zones. Further, the valve plunger displays a constriction that, when the connecting channel has been closed by the shifting of the plunger, makes possible a passage from the channel that connects to the sleeve bearings to a control channel, so that henceforth fed medium is guided by the pump through the sleeve bearings to the control channel. By this means, it can be easily determined at the emission end of the control channel whether the sleeve bearings have been completely cleansed during a material exchange or whether a mixture of products is still dispensed. As soon as the sleeve bearings have been completely cleansed, the valve plungers are shifted back into their original position and henceforth the lubrication of the sleeve bearings takes place in the previously conventional manner, i.e. the fed medium is again recirculated to the suction side of the product channel.

The above-described arrangement can also be used to undertake product testings at the end of the product channel, for example to enable the removal of test samples that are then investigated and to enable the quality of the product fed through the pump to be controlled.

According to a further feature of the invention, the constriction possesses a length that corresponds to the distance of the mouth of the control channel in the housing cover from the mouth of the connecting channel at the outside of the pump housing.

Figure 2:
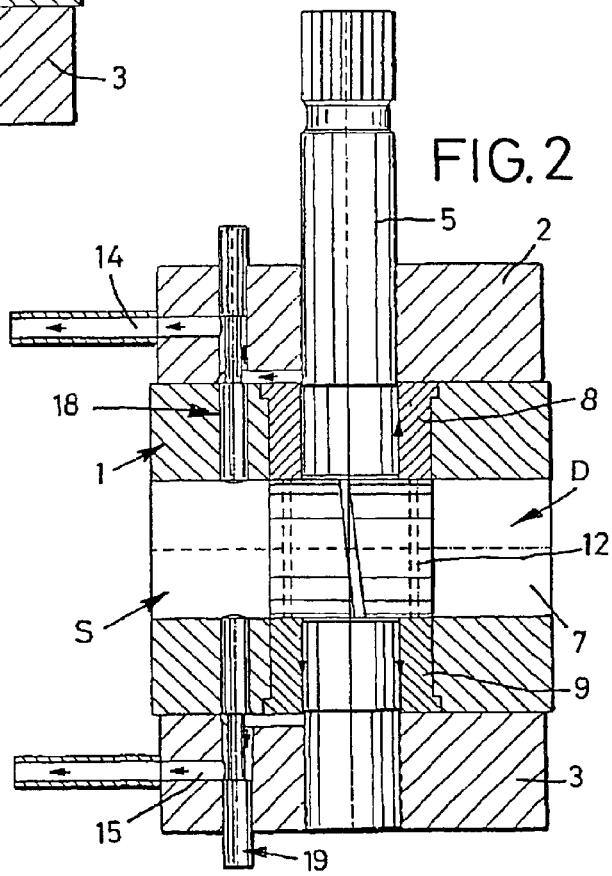

In the following, an embodiment example of the invention is explained with the aid of the drawings. These show:

FIG. 1: the arrangement according to the invention with opened connecting channel FIG. 2: the position of the valve plungers when a connection between the sleeve bearings and a control channel has now been established Labeled as 1 in the drawings is a pump housing, in which is arranged a displacement body 12, for example a gear, which body is active inside a product channel 7. The product channel, along with the displacement body 12, displays a suction side S and a pressure side D. The displacement body 12 is driven by a drive shaft 5 and is seated in sleeve bearings 8 and 9.

Provided at the suction side S of the product channel are connecting channels 10 and 11 through which, as indicated by the arrows in FIG. 1, the medium fed in the product channel is again guided back to the suction side of the product channel 7 after flowing through the sleeve bearings 8 and 9.

Further provided are control channels 14 and 15, which are arranged in housing covers 2 and 3. In addition, arranged in the housing covers 2 and 3 flush with the connecting bores 10 and 11 are bores 16 and 17, which receive the valve plungers 18 and 19. These valve plungers display constrictions 20 and 21, with the length of the valve plunger between its product-channel-side end and the constriction being dimensioned such that this length corresponds to the length of the connecting channels 10 and 11 in the pump housing 1.

If now a product exchange takes place, then (as visible in FIG. 2) each valve plunger 18 or 19 is shifted such that the product-channel-side end adjoining the constriction 20 or 21 closes off the entire connecting bore 10 or 11. Henceforth, the fed medium conveyed in the product channel 7, as indicated by the arrows in FIG. 2, can flow to the control channel 14 or 15 via the region of the constriction 20 or 21. Since both the length and the diameter of the valve plungers are adapted to the length and diameter of the connecting bores 10 and 11, there occurs during the retraction of the valve plungers 18 and 19 into the connecting bores 10 and 11 a simultaneous cleaning of these connecting bores.

The medium flowing through the product channel 7 after the product exchange thus itself cleanses the sleeve bearings, and at the emission ends of the control channels 14 and 15 it can be determined when a completely cleansed fed medium corresponding to that in the product channel 7 exits, so that the valve plungers 18 and 19 can then be restored to the positions shown in FIG. 1 and a normal feeding can again take place.

What is claimed is:

1. A feed pump for fluidic media comprising:

a pump housing including:

a product channel for recirculation of a fed medium that lubricates the sleeve bearings, the product channel having at least a suction side;

a displacement body mounted in said product channel;

sleeve bearings in fluid communication with the product channel; and connecting channels in fluid communication with the sleeve bearings and connected to the product channel on the suction side;

a housing cover position adjacent the housing including:

control channels leading to the exterior of the housing cover and guide channels connected to the control channels and to the connecting channels of the housing;

valve plungers configured to be received in the guide channels of the housing cover, the valve plungers each having a constriction and each having a section positioned adjacent to the product channel of the pump housing that has a length and a diameter that correspond to the length and the diameter of the connecting channel.

2. The feed pump according to claim 1, wherein the constriction has a length that corresponds to the distance from the mouth of the control channel to the mouth of the connecting channel.

* * * * *